United States Patent [19]

Pawolski

[11] Patent Number: 4,869,192

[45] Date of Patent: Sep. 26, 1989

[54] SEMI-SUBMERSIBLE DRILLING UNIT WITH CYLINDRICAL RING FLOATS

[75] Inventor: Jacek S. Pawolski, St. John's, Canada

[73] Assignee: Canadian Patents and Development Limited/Society Canadienne des Brevets et D'Exploitation Limitee, Ottawa, Canada

[21] Appl. No.: 102,642

[22] Filed: Sep. 30, 1987

Related U.S. Application Data

[63] Continuation-in-part of Ser. No. 791,157, Oct. 22, 1985, abandoned.

[51] Int. Cl.[4] ..... B63B 43/06

[52] U.S. Cl. ..... 114/265; 114/123; 114/124; 114/264

[58] Field of Search ..... 114/121, 122, 123, 124, 114/125, 61, 264, 265; 405/200

[56] References Cited

U.S. PATENT DOCUMENTS

| | | | |
|---|---|---|---|
| 2,963,868 | 12/1960 | Armstrong | 405/200 |
| 3,207,110 | 9/1965 | Laborde et al. | 114/125 |
| 3,359,741 | 12/1967 | Nelson | 405/200 |
| 3,408,821 | 11/1968 | Redshaw | 405/200 |
| 4,176,614 | 12/1979 | Goss et al. | 114/125 |

FOREIGN PATENT DOCUMENTS

| | | | |
|---|---|---|---|
| 649499 | 10/1962 | Canada . | |
| 911180 | 10/1972 | Canada . | |
| 987506 | 4/1976 | Canada . | |
| 1108041 | 8/1984 | U.S.S.R. | 114/125 |

*Primary Examiner*—Sherman D. Basinger
*Assistant Examiner*—Thomas J. Brahan
*Attorney, Agent, or Firm*—Wenderoth, Lind & Ponack

[57] ABSTRACT

There is described a vessel such as a semi-submersible drilling unit having a drilling deck structure with a plurality of columns depending from the deck. Pontoons are provided at the ends of the columns and a buoyant configuration modifying sleeve-like element is mounted around the columns. The sleeves are annular in cross-section and of generally cylindrical form and terminate at their lower ends in cuffs of reducing outer diameter. This provides an inwardly tapered or curved end to the sleeve. A cable and pulley arrangement is provided for vertically moving the sleeves along the columns and for locating them on the columns close to the unit transit waterplane and at a survival waterplane position.

28 Claims, 3 Drawing Sheets

SEMI-SUBMERSIBLE DRILLING UNIT WITH CYLINDRICAL RING FLOATS

This is a continuation-in-part of my application Ser. No. 791,157 filed Oct. 22, 1985, now abandoned.

BACKGROUND OF THE INVENTION

The present invention relates to semi-submersible column stabilized vessels such as drilling units of the type which remain afloat and at anchor or dynamically positioned by means of thrusters during drilling operations.

One approach to semi-submersible vessels has been to provide sufficient submerged structure to provide compensating weight so that the centre of gravity of the vessel is below the centre of buoyancy. Such structures are very large and costly to build and consequently the trend has been to construct semi-submersible column stabilized vessels, that is to say, vessels in which the centre of buoyancy is located beneath the centre of gravity and which, therefore, depend on positive metacentric height and righting arms for maintaining their upright configuration when afloat.

Recent disasters and near disasters with deep sea semi-submersible drilling rigs have caused the safety of certain hitherto accepted rig designs to be called into question. However, because drilling rigs are so functional in their form with their pairs of slender columns providing a small waterplane area it has been difficult for naval architects to realise how to improve the survival capability of the drilling units without interfering with their drilling function.

Two major economic factors govern the design of semi-submersible drilling units, the amount of Variable Deck Load (VDL, which is the weight which can be carried, typically about 1.5 m above the pipe racks) and the weather window (WW, which is the average number of days per year when the unit can perform drilling owing to sufficiently small wave induced motions). There exists a conflict in the requirements of large VDL and WW, since VDL is limited by stability requirements, and a large waterplane area, whilst being conducive to satisfactory stability, is decidedly detrimental to the motion characteristics.

As a result, drilling units are designed to perform drilling at drilling draught in moderate weather conditions and to have the capability to reduce draught and top deck load significantly and in a reasonably short period of time in order to withstand severe storm conditions. The procedures for this operation dictate that sufficient ballast and consumables should be discharged overboard in the process.

It follows that a significant improvement in semi-submersible design can be achieved if:

(a) VDL is increased without adverse affects upon WW, (b) the necessity of discharging ballast and consumables in order to change the mode of operation between the drilling and survival draught is reduced or eliminated.

For the purpose of enhancing the VDL capability of semi-submersible drilling units, one or more of the following modifications are normally introduced: additional columns; blisters on the column to pontoon connections in order to improve transit stability; blisters on the columns at operating draught; and increase in pontoon displacement.

Addition of columns and/or blisters on the columns at operating draught adversely affects the forces exerted upon the vessel by waves and currents during operation and may involve a significant increase of constructions costs.

Increase in pontoon displacement does not overall affect stability if it does not involve a corresponding increase of the amount of ballast, and hence it does not provide efficient means of improving stability; besides, it can also be expensive. Blisters on the column to pontoon connections, although important for the transit condition, do not influence stability at the drilling and survival draughts.

SUMMARY OF THE INVENTION

The present invention seeks to improve the survival capabilities of a semi-submersible vessel of the type that is afloat and at anchor or dynamically positioned when in on site operation and which has its centre of buoyancy located beneath its centre of gravity, by providing for a variable geometry of the volume of buoyancy and accordingly provides a vessel comprising a deck structure; a plurality of columns depending therefrom; pontoon means on at least one of the columns; the deck structure, columns and pontoon means being of fixed permanent configuration with respect to each other, a buoyant configuration modifying element on at least one of the columns; and means for translating the buoyant configuration modifying element along its associated column with respect to the waterline when the vessel is afloat and for locating the element close to the vessel transit water plane and at a survival waterplane position, on the associated column, without essentially changing the height of the vessel.

According to a preferred form of the invention a semi-submersible column stabilized drilling unit of the type that is afloat and at anchor or dynamically positioned when in on site operation and which has its centre of buoyancy located beneath its centre of gravity, comprises a drilling deck structure; a plurality of columns depending therefrom; pontoon means at the ends of at least certain of the columns; the deck structure, columns and pontoon means being of fixed permanent configuration with respect to each other; buoyant configuration modifying sleeve-like elements mounted around at least certain of the columns; the sleeve-like elements being substantially annular in cross-section, of generally cylindrical form and terminating at their lower ends in cuffs of reducing outer diameter to provide an inwardly directed end to the sleeve; and means for translating the sleeve-like elements along their associated columns with respect to the waterline when the unit is afloat and for locating them thereon close to the unit transit waterplane and also at a survival waterplane position, without essentially changing the height of the vessel.

Conveniently the thickness of the annular cross-section sleeve-like members and their height above the cuffs is uniform and is selected to produce an optimum increase in the waterplane moment of inertia at the survival waterplane position and to accommodate for a sufficient range of displacement relative to the water surface resulting from the motion of the vessel and/or wave motion.

The transit condition of the drilling unit is improved by positioning the sleeve-like members immediately above the pontoons where they co-operate with the pontoons to increase the waterplane moment of inertia at the transit waterplane.

Inward tapering or curving of the cuffs at the sleeve-ends (to reduce their center diameter) serves to reduce the impact effects at the entry of the sleeve-like element into the water at either the unit transit waterplane or at the unit survival waterplane. The cuffs also can serve to graduate the hydrostatic stiffness of the unit.

In another aspect the invention provides a vessel of the type that is afloat when in on site operation and which has its centre of buoyancy located beneath its centre of gravity and having a water immersible column means; a buoyant configuration modifying element on the column means; and means for translating the buoyant configuration element along the column means and for locating the element at a first, vessel waterplane, position near an upper end of the column means and at a second position on the column means spaced from and beneath the first position, close to the bottom of the column means, without essentially changing the height of the vessel.

The present invention also provides a method for stabilizing a semi-submersible vessel of the type that remains afloat and at anchor or dynamically positioned by means of thrusters when in on site operation and which has its centre of buoyancy located beneath its centre of gravity and depends on positive metacentric height and righting arms for maintaining an upright configuration when afloat, the vessel having a deck structure; a plurality of columns depending therefrom; pontoon means on at least one of the columns; the deck structure, columns and pontoon means being of fixed permanent configuration with respect to each other; a buoyant configuration modifying element on at least one of the columns; and means for translating the buoyant configuration modifying element along its associated column with respect to the waterline when the vessel is afloat, the method comprising the steps of locating the element on the associated column;

(a) adjacent the pontoon means close to the vessel transit waterplane during vessel transit;
(b) adjacent and above the pontoon means and beneath the water during a drilling operation; and
(c) at a survival waterplane position to increase pitching, heaving and rolling of the vessel with the waves during heavy weather conditions.

According to a further feature of the invention there is provided a method for stabilizing a semi-submersible vessel of the type that remains afloat and at anchor or dynamically positioned by means of thrusters when in on site operation and which has its centre of buoyancy located beneath its centre of gravity and depends on positive metacentric height and righting arms for maintaining an upright configuration when afloat, the vessel having a water immersible column means; a buoyant configuration modifying element on the column means; and means for locating the buoyant configuration modifying element along the column means at a vessel survival waterplane position near an upper end of the column means to increase pitching, heaving and rolling of the vessel with the waves during heavy weather conditions and a second position on the column means spaced from and beneath the first position, in calm water conditions.

BRIEF DESCRIPTION OF THE DRAWINGS

The following is a description by way of example of one embodiment of the invention as it applies to drilling units, reference being had to the accompanying drawings in which.

FIGS. *6a*, *6b*, show the geometry of a structure in accordance with the present invention, *6a* with a bouyant configuration modifying element submerged and *6b* with the element at the waterplane; and FIGS. *7a* and *7b* are views similar to FIGS. *6a* and *6b* but showing a single column device.

DETAILED DESCRIPTION OF THE DRAWINGS

Turning now to the drawings, 10 generally shows a semi-submersible column stabilized drilling unit (that is to say a vessel wherein its center of bouyancy is below its center of gravity) having a drilling deck structure 12, with a plurality of columns 14 depending therefrom. The columns conveniently may be of circular cross-section although it is to be understood that they could take other shapes, for example, rectangular cross-section. Pontoons 16 of conventional form are fixed to the bottoms of the columns 14 of conventional form and so far this is a standard structure. 18 shows the transit waterplane, that is to say the plane of the water when the drilling unit is being towed or propelled into position and is at its transit draught with the tops of the pontoon hulls just clear of the water and 20 designates the drilling waterplane, which for practical purposes can be also regarded as the survival waterplane although this plane can be different. The distance of the deck 12 above the water surface in the survival condition should not be reduced, owing to relative motions of the vessel and waves, below certain limits if the vessel is to survive a storm or avoid damage.

Figure 1:
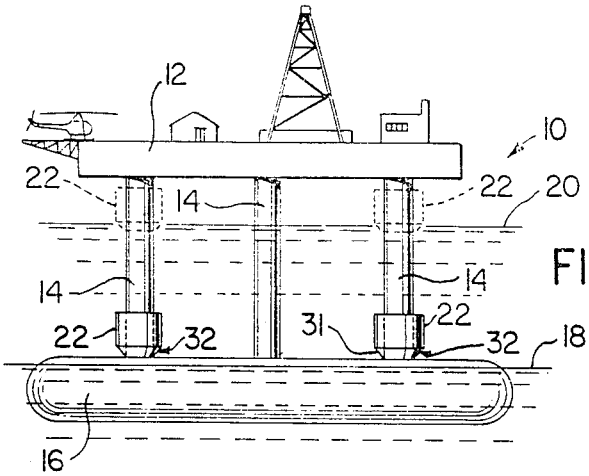
FIG. 1 is a schematic view of a semi-submersible drilling unit indicating its capability to vary the geometry of its volume of buoyancy.
Figure 1A:
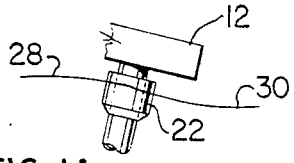
FIG. 1A is a detail of part of the right hand end column as seen in FIG. 1 operating in rough water.
Figure 3:
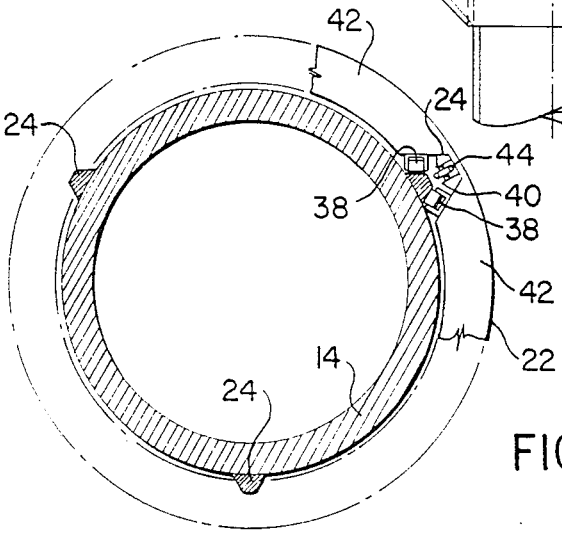
FIG. 3 is a detail in plan view showing, schematically, a means for translating the sleeve element on the column.

Buoyant configuration modifying elements 22 of sleeve-like configuration are mounted around the end columns 14 on guideways 24 (see FIG. 3). The sleeve-like elements 22 are substantially annular in cross-section and of generally cylindrical form. The thickness$\Delta r$ of the annular cross-section of the elements 22 and the height H of the cylindrical portion of the element 22 are selected to provide the desired increase in the waterplane moment of inertia of the drilling unit 10 at the survival waterplane 20, when the elements 22 are locked in position at the survival waterplane 20 as shown in FIG. 1. The height H is selected to accommodate for a sufficient range of displacement relative to the water surface, resulting from the motion of the vessel and/or wave motion as indicated at 30. The elements 22 terminate at their lower ends in cuffs 32 which are of reducing outer diameter to provide an inwardly tapered surface 31 i.e., as shown, an inverted frustoconical configuration, or maybe an inwardly directed curving configuration. This inwardly tapered or curved end to the sleeves reduces the impact effects at the entry of the sleeve-like element into the water.

As best seen in FIG. 3, the longitudinally extending guideways 24 on the columns 14 are engaged by co-operating guideway engaging means in the form of rollers 38 located in slots 40 provided between segments 42 of the annular wall of the element 22. Suitable translating means, here schematically shown as a cable and pulley system 44 are also provided in the slot 40 and are operated by winches (not shown) on the deck 12 to translate the element 22 longitudinally of the column 14 between the lower, or transit, position as seen in FIG. 1 and the upper, or survival waterplane position. It will be appreciated that the element 22 will be locked to the column in either of the two positions and indeed in certain circumstances provision may be made to lock the element to the column in positions other than that shown in FIG. 1 to provide for varying operational conditions.

Initially, when the drilling unit is being towed or propelled to the drilling site the element 22 will be locked to the column at the pontoon level and here if a major sea is encountered during towing the element 22 serves to increase the moment of inertia of the waterplane of the structure by adding to the waterplane area at the pontoon level. The configuration of the cuff 32 absorbs the shock of waves and/or motions tending to submerse the pontoon and the height H of the element 22 serves to provide an increased range of stability improvement during towing conditions.

On reaching the drilling site the pontoons are flooded to the necessary degree to submerse the drilling unit to the drilling waterplane 20 where it is anchored or dynamically positioned by thrusters. During this operation the element 22 remains locked to the column in its lower position and is thus underwater.

Figure 2:
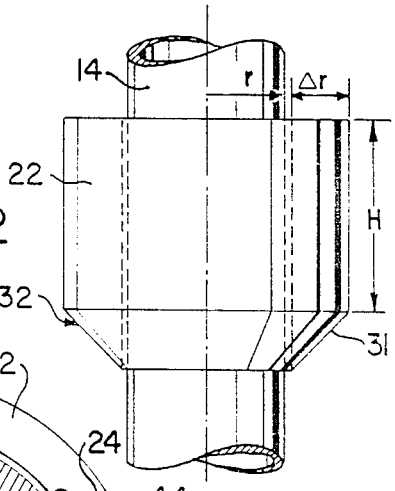
FIG. 2 is a detail of a sleeve-like element mounted on a column.

During drilling, the relatively thin columns 14 of radius r (FIG. 2) provide minimum waterplane area for the drilling unit and therefore minimum wave induced motions in acceptable drilling weather conditions. However, when a storm warning is received the element 22 is unlocked from its lower position on the column and translated up to the survival waterplane condition where it is again locked. In this condition it increases the waterplane of the column and alters the vertical distribution of the volume of buoyancy. Because the thickness of the annulus$\Delta r$ and the height H of the elements 22 have been designed to provide the necessary increase in waterplane moment of inertia and necessary height to accept the major relative motions, and because vessel motions are no longer a factor, the drilling unit can be permitted to ride out the waves, pitching and rolling with the waves to maintain the drilling deck structure 12 a safe distance above the wave top 28. After subsidence of the storm the cable and pulley elements 44 can he operated to cause the elements 22 to be forced down along the guideways 24 back into an underwater position, likely the lower position shown in FIG. 1. The element 22 is then locked in that position and the drilling can recommence with the column 24 again assuming its small cross-section suitable at the waterplane to provide for the reduction of wave induced motions necessary for drilling.

Figure 4:
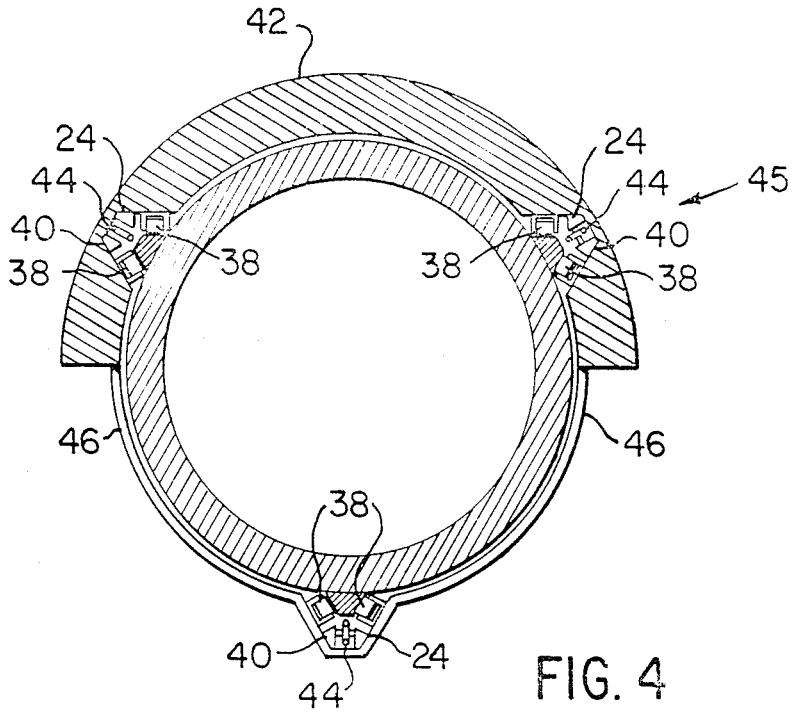
FIG. 4 is a detail similar to FIG. 3 but showing a different form of buoyant configuration modifying element.

Although the elements 22 have been shown herein on each of the columns carrying pontoons it is to be understood that under certain conditions the elements 22 may not be provided on all columns, or again that special columns may be provided for the purpose of carrying elements 22. It is also to be understood that whilst the elements 22 have been shown as being generally cylindrical in form, they could be of other configurations, for example they could be toroidal, or they could be segmented so as to extend only over part of the circumference of the column as shown at 22*a* in FIG. 4. These segments 22*a*, conveniently, may be mounted on a circular carriage 46 which engages the guideways 24 (in similar fashion to the configuration described with respect to FIG. 3), to positively locate the segment 22*a*. They should be designed however to provide good safety against puncture and indeed preferably, in order to avoid puncturing and flooding, the elements 22 may be filled with concrete or some other suitable substance so that in the event of rupture of the skin of the element 22, water will not be admitted to an empty interior thereof and be able freely to flow into and out of it.

It is further envisaged that the plurality of elements 22 may be replaced by the single element on a central column through which the drill shaft passes and of course any suitable form of element translating means, guide means or locking means may be employed.

Figure 5:
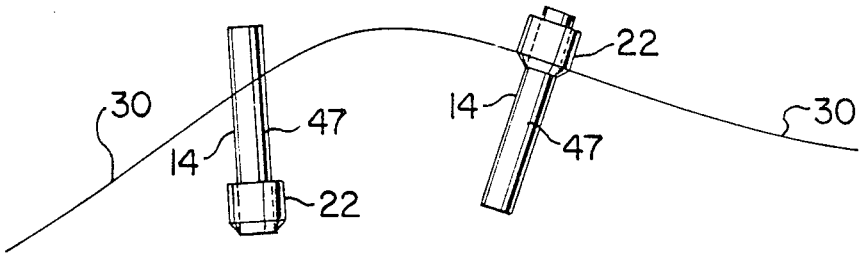
FIG. 5 is a schematic view of a single cylindrical buoy having a sleeve-like element mounted thereon.
Figure 6A:
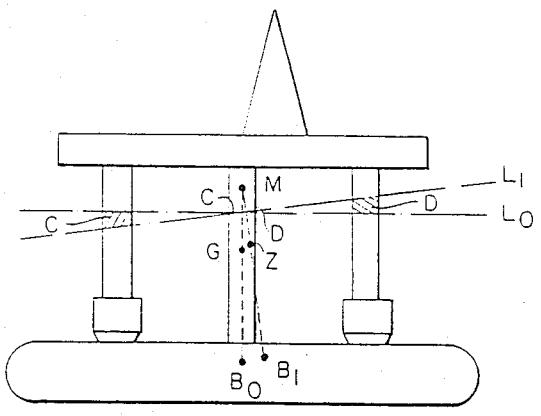
Figure 6B:
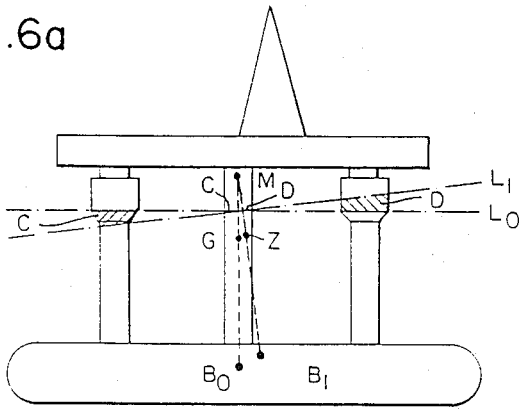
Figure 7A:
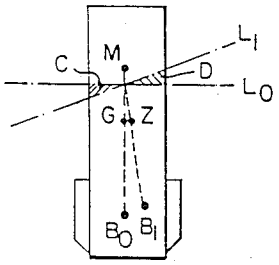
Figure 7B:
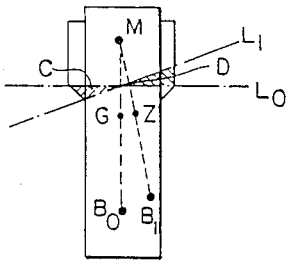

In FIG. 5 there is shown a somewhat different application 5 of the invention. Here a cylindrical buoy 47 has a single column means 14. In this instance no pontoon is attached to the column means. A buoyant configuration modifying element such as the sleeve-like element 22 is translatably mounted on the column 14 and movable so as to be located at a first or, vessel waterplane, position, seen at the right in FIG. 5 and at a second position, at the bottom of the column 14, as seen at the left of FIG. 5. Again the element 22 will be locked at the lower end of the buoy when minimum wave induced motions of the buoy are desirable. When maximum clearance of the top end of the buoy above the water surface is demanded, the element 22 is locked at the waterplane.

In FIGS. 6*a*, 6*b* and 7*a*, 7*b* the geometry of vessels in accordance with the present invention is illustrated. In these drawings:

G- is the centre of gravity;

$B_o$- is the centre of buoyancy in the upright configuration (waterline $L_o$);

$L_1$- is waterline in a heeled configuration;

$B_1$- is centre of buoyancy corresponding to the heeled configuration;

Z- is the projection of G on the line perpendicular to $L_1$ drawn through $B_1$ (line of action of buoyancy force in the heeled configuration);

GZ- is righting arm in the heeled configuration; the righting moment of the weight and buoyancy forces, which restores the vessel to its upright configuration is proportional to the length of GZ;

M- is metacentre;

GM- is metacentric height

GZ- for 6*a* is smaller than for 6*b*, because for 6*b* the shift of the centre of buoyancy is greater due to the presence of collars at the waterline; the increase of GZ depends on the increase of the moment of inertia of the waterplane area, provided by the presence of collars. Similar effect is observed for 7*a* and 7*b* respectively, where the increase of GZ for 7*b* results from the presence of the colar at the waterline;

C- is emerged volume due to heel;

D- is submerged volume due to heel.

These Figures illustrate that by positioning the bouyant configuration modifying element, or elements; along the columns to a vessel survival waterplane position, pitching, heaving and rolling of the vessel with the waves is increased during heavy weather conditions.

I claim:

1. A semi-submersible column stabilized vessel of the type that is afloat and at anchor or dynamically positioned when in on site operation and which has its centre of buoyancy located beneath its centre of gravity, comprising a deck structure; a plurality of columns depending therefrom; pontoon means on at least one of said columns; said deck structure, columns and pontoon means being of fixed permanent configuration with respect to each other, a buoyant configuration modifying element on at least one of said columns; and means for translating the buoyant configuration modifying element along its associated column with respect to the waterline when the vessel is afloat and for locating said element close to a transit waterplane of the vessel and at a survival waterplane position, on said associated column, without essentially changing the height of the vessel.

2. A vessel as claimed in claim 1 in which a plurality of said buoyant configuration modifying elements are mounted one on each of a plurality of said columns.

3. A vessel as claimed in claim 2 in which at least one of said buoyant configuration modifying elements is of generally cylindrical form having a substantially annular cross-section and is mounted so as to tend to surround said associated column.

4. A vessel as claimed in claim 2 in which the buoyant configuration modifying elements are of generally cylindrical form having a substantially annular cross-section and are mounted so as to tend to surround said associated columns.

5. A vessel as claimed in claim 2 in which at least one of said buoyant configuration modifying elements is of partly cylindrical form having a segmented annular cross-section and is mounted so as to partially surround the associated column.

6. A semi-submersible column stabilized drilling unit of the type that is afloat and at anchor or dynamically positioned when in on site operation and which has its centre of buoyancy located beneath its centre of gravity, comprising a drilling deck structure; a plurality of columns depending therefrom; pontoon means at the ends of at least certain of said columns; said deck structure, columns and pontoon means being of fixed permanent configuration with respect to each other; buoyant configuration modifying sleeve-like elements mounted around at least certain of said columns; said sleeve-like elements being substantially annular in cross-section, of generally cylindrical form and terminating at their lower ends in cuffs of reducing outer diameter to provide an inwardly directed end to the sleeve; and means for translating the sleeve-like elements along their associated columns with respect to the waterline when the unit is afloat and for locating them thereon close to the unit transit waterplane and also at a survival waterplane position, without essentially changing the height of the vessel.

7. A unit as claimed in claim 6 in which the thickness of the annular cross-section sleeve-like elements and their height above their cuffs is uniform.

8. A unit as claimed in claim 6 in which said cuffs are of generally inverted frusto-conical shape.

9. A unit as claimed in claim 6 in which all the columns terminate in pontoons and sleeve-like elements are provided on all columns.

10. A unit as claimed in claim 9 in which each of the columns is provided with a plurality of longitudinally extending guideways and said sleeve-like elements are provided with cooperating guideway engagement means.

11. A unit as claimed in claim 9 in which in said position close to the unit transit waterplane, said sleeve-like elements are located immediately above said pontoon means.

12. A unit as claimed in claim 11 in which each of the columns is provided with a plurality of longitudinally extending guideways and said sleeve-like elements are provided with cooperating guideway engagement means.

13. A vessel of the type that is afloat when in on site operation and which has its centre of buoyancy located beneath its centre of gravity and having a water immersible column means; a buoyant configuration modifying element on said column means; and means for translating the buoyant configuration element along said column means and for locating said element at a first, vessel waterplane, position near an upper end of said column means and at a second position on the column means spaced from and beneath said first position, close to the bottom of said column means, without essentially changing the height of the vessel.

14. A method for stabilizing a semi-submersible vessel of the type that remains afloat and at anchor or dynamically positioned when in on site operation and which has its centre of buoyancy located beneath its centre of gravity and depends on positive metacentric height and righting arms for maintaining an upright configuration when afloat, said vessel having a water immersible column means; a buoyant configuration modifying element on said column means; and means for locating said buoyant configuration modifying element along the column means at a vessel survival waterplane position near an upper end of said column means to increase pitching, heaving and rolling of the vessel with the waves during heavy weather conditions and a second position on the column means spaced from and beneath said first position, in moderate weather conditions.

15. A semi-submersible vessel of the type that is afloat when in on-site operation comprising a deck structure; a plurality of water-immersible columns depending therefrom; pontoon means on at least one of the columns; a buoyancy-configuration modifying element on at least one of the columns; and means for translating the configuration modifying element along its associated column and locating it at a vessel survival waterplane location which is a rough-water position and which is near an upper end of the column, in which location the vessel rises and falls with the waves, and at a second location which is a calm-water operating position on the column and which is below the first location and below the waterline, in which location movement of the vessel with the waves is reduced, and at a third location which is a transit position spaced from or coincident with the second location, for vessel transit.

16. A semi-submersible vessel as claimed in claim 15 in which the buoyancy-configuration modifying elements are mounted on a plurality of the columns.

17. A vessel as claimed in claim 16 in which at least one of the buoyancy-configuration modifying elements is of generally cylindrical form having a substantially annular cross-section and is mounted so as to surround the associated column.

18. A vessel as claimed in claim 16 in which the buoyancy-configuration modifying elements are of generally cylindrical form having a substantially annular cross-section and are mounted so as to surround their said associated columns.

19. A vessel as claimed in claim 16 in which at least one of the buoyancy-configuration modifying elements is of partly cylindrical form having a segmented annular cross-section and is mounted so as to partially surround the associated column.

20. A semi-submersible vessel of the type that is afloat when in on-site operation comprising a drilling deck structure; a plurality of water-immersible columns depending therefrom; pontoon means at the ends of at least certain of the columns; buoyancy-configuration modifying sleeve-like elements mounted around at least certain of the columns; the sleeve-like elements being substantially annular in cross-section, of generally cylindrical form and terminating at their lower ends in cuffs of reducing outer diameter to provide an inwardly tapered or curved end to the sleeve; and means for translating the sleeve-like elements along their associated columns and locating it at a vessel survival waterplane location which is a rough-water position near an upper end of the respective columns in which location the vessel rises and falls with the waves, and at a second location which is a calm-water operating position on the respective columns and which is below the first location and below the waterline, in which location movement of the vessel with the waves is reduced, and at a third location, a transit position spaced from or coincident with the second location, for vessel transit.

21. A vessel as claimed in claim 20, in which the thickness of the annular cross-section sleeve-like members and their height above their cuffs is uniform.

22. A vessel as claimed in claim 20 in which the cuffs are of generally inverted frusto-conical shape.

23. A vessel as claimed in claim 20 in which all the columns terminate in pontoons and sleeve-like members are provided in all columns.

24. A vessel as claimed in claim 23 in which in the third location the sleeve-like members are located immediately above the pontoon.

25. A vessel as claimed in claim 24 in which each of the columns is provided with a plurality of longitudinally-extending guideways and the sleeve-like members are provided with cooperating guideway engagement means.

26. A vessel as claimed in claim 23 in which each of the columns is provided with a plurality of longitudinally-extending guideways and the sleeve-like members are provided with cooperating guideway engagement means.

27. A semi-submersible vessel of the type that is afloat when in on-site operation, including water-immersible column means, a buoyancy-configuration modifying element on the column means, and means for translating the configuration modifying element along the column means and locating it at a vessel survival waterplane location which is a rough-water position and which is near an upper end of the column means, in which location the vessel rises and falls with the waves, and at a second location which is a calm-water operating position on the column means and which is below the first location and below the waterline, in which location movement of the vessel with the waves is reduced.

28. A method for stabilizing a vessel of the type that is afloat when in on-site operation and relies on the change of its waterplane area for its stability, said vessel having a water-immersible column means; a buoyant configuration modifying element on said column means; and means for locating said buoyant configuration modifying element along the column means at a vessel survival waterplane position near an upper end of said column means to increase pitching, heaving and rolling of the vessel with the waves during heavy weather conditions and a second position on the column means spaced from and beneath said first position, in calm-water conditions.

* * * * *